United States Patent [19]

Hennecke et al.

[11] Patent Number: 4,817,733

[45] Date of Patent: Apr. 4, 1989

[54] HYDRAULIC PILE DRIVER

[75] Inventors: Rudolf Hennecke, Buoch; Achim Kehrberger, Ostfildern, both of Fed. Rep. of Germany

[73] Assignee: Delmag Maschinenfabrik Reinhold Dornfeld GmbH & Co., Fed. Rep. of Germany

[21] Appl. No.: 31,664

[22] Filed: Mar. 30, 1987

[30] Foreign Application Priority Data

Jan. 7, 1987 [DE] Fed. Rep. of Germany ... 8700227[U]

[51] Int. Cl.[4] ..... B21J 7/08

[52] U.S. Cl. ..... 173/2; 173/21; 173/115

[58] Field of Search ..... 173/2, 4, 10, 20, 21, 173/112, 115; 175/135

[56] References Cited

U.S. PATENT DOCUMENTS 4,156,467 5/1979 Patton et al. ..... 173/21
4,271,475 6/1981 Sahajdak ..... 173/21

FOREIGN PATENT DOCUMENTS 2069146 8/1981 United Kingdom ..... 173/10

*Primary Examiner*—Frank T. Yost
*Assistant Examiner*—James L. Wolfe
*Attorney, Agent, or Firm*—Fred Philpitt

[57] ABSTRACT

In a hydraulic pile driver (10), the lifting cylinder (34) acting on the driving weight (12) has an attached position indicator (46, 50), which produces a signal corresponding to the momentary position of the piston rod (32) of the lifting cylinder (34). This signal is used for reversing a 4/3-valve, by which the two working chambers of the lifting cylinder can be connected to a pressure line or return line.

12 Claims, 2 Drawing Sheets

HYDRAULIC PILE DRIVER

DESCRIPTION

Figure 1:
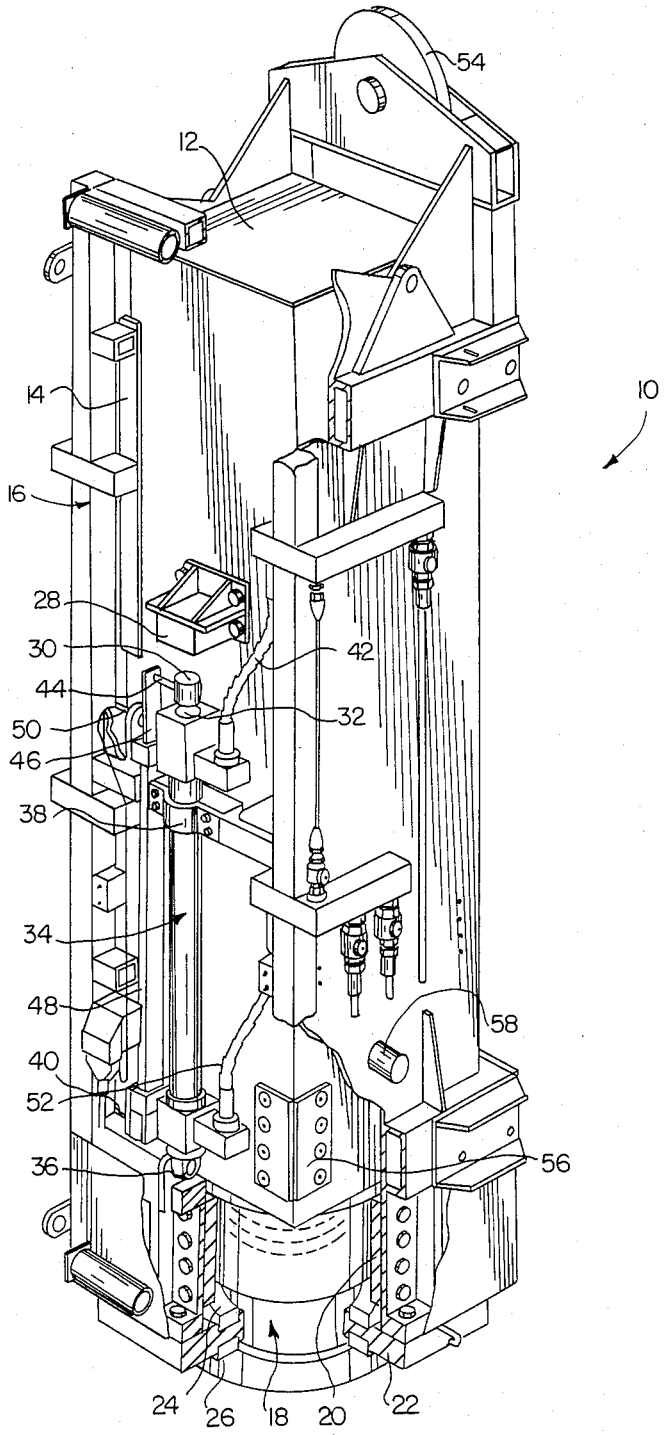

The invention relates to a hydraulic pile driver according to the preamble of claim 1.

Hydraulic pile drivers of this type serve for driving piles and the like into the ground. For this purpose a driving weight is raised using a lifting cylinder. After reaching the desired drop height, the driven part of the lifting cylinder is retracted so quickly by reversing the supply of pressure medium, that this driven part can no longer be caught up by the driving weight. The downwards movement of the driving weight thus ends with the impact on a driving member, which acts on the object to be driven in (pile or the like).

The drop height of the driving weight necessary in each case depends primarily on the object to be driven in and the nature of the ground into which the object is to be driven. Particularly at the beginning of the driving-in operation, the hydraulic pile driver fitted to the object to be driven in is located high above the surface of the ground, so that a visual inspection as to whether the lifting cylinder has raised the driving weight to the desired drop height is quite difficult. It is therefore already been proposed to control the supply of pressure medium to the lifting cylinder in a time-dependent manner, in which case in addition the supply pressure of the hydraulic pump used can be taken into consideration, possibly by way of the speed of the internal combustion engine driving the hydraulic pump. Even this type of control does not work completely satisfactorily in practice, since it cannot take into consideration the friction ratios which as a rule are not reproducable. However, in hydraulic pile drivers friction plays an important part, since the driving weight is guided by a guide device, which must withstand very rough conditions of use and thus cannot be designed for low friction ratios. Moreover, in hydraulic pile drivers of this type, for reasons of cost frequently only a single lifting cylinder is used, which engages on only one of the lateral surfaces of the driving weight, so that at the time of lifting relatively great tilting moments are necessarily exerted on the driving weight.

The present invention is therefore intended to develop a hydraulic pile driver according to the preamble of claim 1 so that the change-over of the reversing valve takes place reliably on reaching the desired drop height of the driving weight and indeed even if the friction ratios vary in an uncontrolled manner.

This object is achieved according to the invention by a hydraulic pile driver according to claim 1.

In the hydraulic pile driver according to the invention, a position indicator cooperates directly with the driven part of the lifting cylinder, so that the output signal of this position indicator is an exact measurement of the momentary lifting distance of the driving weight. Thus, independently of varying friction ratios, this output signal may accomplish the change-over of the reversing valve determining the application of pressure to the double-acting lifting cylinder so that one has exactly the same drop height in successive driving operations. Due to this it is ensured on the one hand that the object to be driven in is not subjected to any inadmissibly high impact loads (which would be the case in the known hydraulic pile drivers, if the lifting of the driving weight takes place under unexpected favourable friction ratios), on the other hand the driving-in is completed in the shortest possible time, since each impact takes place with the maximum admissible impact force, whereas in the known hydraulic pile drivers operating on a time basis, if the lifting of the driving weight takes place under unfavourable friction conditions, this may also lead to weaker impacts.

Advantageous developments of the invention are described in the sub-claims. With the development of the invention according to claim 2, it is ensured that even the re-lifting of the driving weight after carrying out an impact can take place under automatic control. The operation of the hydraulic pile driver thus requires only a minimum of attention by the operator.

With the development of the invention according to claim 3, it is ensured that the downwards movement of the driving weight comes to a standstill reliably before the driven part of the lifting cylinder is again extended.

The development of the invention according to claim 4 makes it possible to ascertain in a very simple manner the impact of the driving weight on the driving member independently of the respective position of the driving member in the driving member guide. The output signal of the impact indicator constructed according to claim 4 can be evaluated in a particularly simple manner in order to derive the dynamics of the driving operation which has just been carried out (see claim 13). According to the dynamics of the driving operation which has just been carried out, the drop height for the next driving operation to be carried out can be pre-determined automatically and in this way one can automatically take into account layers of the ground of different hardness.

The developments of the invention according to claims 5 to 8 are an advantage with regard to a simple and trouble-free construction of the position indicator cooperating with the driven part of the lifting cylinder.

The development of the invention according to claim 9 makes it possible to carry out the change-over of the reversing valve using economical digital components.

Figure 2:
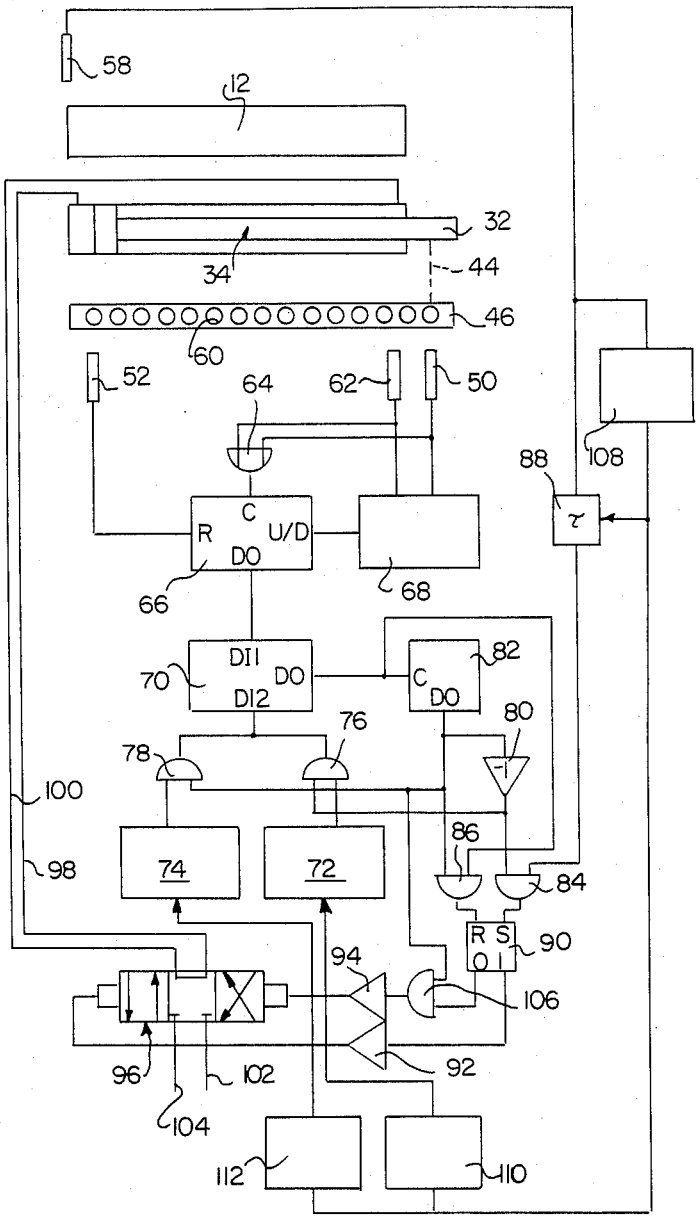

The invention will be described in detail hereafter with reference to an embodiment and referring to the drawings, in which:

FIG. 1 is perspective view of the most important parts of a hydraulic pile driver, in which some parts are cut-away; and FIG. 2 is a block circuit diagram of the hydraulic and electrical circuits for operating the pile driver shown in FIG. 1.

The hydraulic pile driver designated generally by the reference numeral 10 and illustrated in FIG. 1 has a prismatic driving weight 12, which in practice may weigh 5, 7 or more tons. The driving weight 12 is guided by guide plates 14 of wear-resistant material, which are in turn supported by a basket-shaped frame 16. The latter consists of a plurality of steel sections extending in the vertical and horizontal directions.

A substantially cylindrical driving member 18 is guided to move in the longitudinal direction of the frame, at the lower end of the frame 16. For this purpose the frame 16 supports a driving member guide 20.

As can be seen from the drawings, resilient damping rings 24, 26 are fitted to the upper and lower side of a lower end plate 22 of the frame, which rings damp the movement of the driving member 18 in a downwards direction at the time of the driving operation or damp the abutment of the frame 16 against the driving member 18 when the driving weight 12 is raised again.

For lifting the driving weight 12, an entrainment block 28 is screwed to one of its side faces. The block 28 lies in the path of an entrainment head 30, which is fitted to the piston rod 32 of a lifting cylinder 34. The lifting cylinder 34 is supported in an articulated manner by a pin 36 on the frame 16 of the hydraulic pile driver 10 at the lower end in the drawing. Its upper end is securely connected to the frame by a bracket 38. The lifting cylinder 34 is a double-acting working cylinder and its two working chambers can be supplied with hydraulic oil under pressure by way of hoses 40, 42.

The entrainment head 30 is connected by way of a rod 44 to a measuring rule 46, which extends parallel to the axis of the lifting cylinder 34 and is inserted with clearance in a sleeve 48. The measuring rule 46 is provided with marks which are not shown in detail in FIG. 1 and cooperates constantly with an upper inductive sensor 50, whereas as a lower inductive sensor 52 is only actuated when the lifting cylinder 34 has reached its lower final position.

The control of the supply of pressure medium to the pressure cylinder 34 will be described in detail hereafter with reference to FIG. 2.

Roughly speaking, the hydraulic pile driver illustrated in FIG. 1 operates as follows:

The entire hydraulic pile driver can be moved as a whole in the vertical direction by way of a cable not shown in FIG. 1, which travels over a roller 54 supported by the upper end of the frame 16 and is placed on the upper end of a pile or the like to be driven in, the object to be driven in generally supporting an impact hood (not shown) protecting its upper end.

By extending the piston rod 32 of the lifting cylinder 34, the entrainment head 30 is brought into abutment with the entrainment block 28 and during further extension of the piston rod 32, the driving weight 12 is raised. The tilting moment exerted in this case on the driving weight 12 is taken up by the guide plates 14 and by wear-resistant guide plates 56 supported by the lower end of the driving weight 12. As the piston rod 32 is extended, the successive marks on the measuring rule 46 are moved passed the inductive sensor 50, which prepares a corresponding number of output pulses. By counting the latter, it is thus possible to ascertain exactly and independently of the respective friction ratios, by what distance the driving weight 12 has been raised. When one has received the number of output pulses of the sensor 50 corresponding to the desired drop height of the driving weight 12, the supply of pressure medium to the lifting cylinder 34 is reversed so that the piston rod 32 is rapidly retracted. The driving weight 12 cannot follow this rapid retraction movement, so that the path below the entrainment block 28 is completely clear and the driving weight 12 can drop freely. The driving weight 12 then strikes with its lower end face against the upper side of the driving member 18, which drives the object to be driven in into the ground. A corresponding relative movement between the driving member 18 and the frame 16 is ensured by the driving member guide 20. Moreover, at the time of driving-in, the cable travelling over the roller 54 is relieved of load, so that the frame 16 as a whole may also drop.

The impact of the driving weight 12 on the driving member 18 is picked up by a microphone 58, which is supported by the frame 16. Depending on whether the impact which has just occurred is a hard or rather a soft impact according to the respective conditions of the ground, the output signal of the microphone 58 is a high and short pulse signal or rather a lower and longer signal. By evaluating the trend of the microphone output signal with respect to time, one thus constantly obtains information about the actual driving-in conditions.

FIG. 2 shows a block circuit diagram of the hydraulic and electronic components, which serve for the continuous automatic control of the supply of pressure medium to the lifting cylinder 34.

As shown in FIG. 2, recesses 60 are milled at regular intervals in the measuring rule 46 made of iron, which recesses represent the marks cooperating with the inductive sensor 50. In addition to the sensor 50, in FIG. 2 a further sensor 62 located at the upper end of the lifting cylinder 34 is provided, which has the same construction as the sensor 50, but is offset with respect to the sensor 50 by an uneven multiple of half the spacing of the measuring rule 46. The sensors 50 and 62 are shown solely diagrammatically, corresponding operating circuits and signal-forming circuits also belong thereto. For the purposes of the present description it is assumed that the sensors 50, 62 and also the sensor 52 each produce a signal when a recess 60 of the measuring rule 46 lies opposite thereto.

The output signals of the sensors 50 and 62 are sent to the counting terminal C of an up/down counter 66, collated by way of an OR-gate 64. The re-setting terminal R of the counter 66 receives a signal from the sensor 52 actuated in the end position of the measuring rule 46.

The sensors 50 and 62 are also connected to the inputs of a direction discriminator 68, which from the sequence of leading and trailing signal edges at the outputs of the sensors 50 and 62 can determine the direction of movement of the measuring rule 46 and thus of the lifting cylinder 34. Accordingly it provides a signal corresponding to the direction of movement of the lifting cylinder 34 at its output, which is supplied to the up/down control terminal U/D of the counter 66.

The data output DE of the counter 66 is connected to a first data input DI 1 of a comparator 70. At a second input DI 2, the latter receives a reference signal, which is made available either by an adjusting circuit 72 for the upper final position of the lifting cylinder 34 or an adjusting circuit 74 for the lower final position of the lifting cylinder 34. The control of the connection between the adjusting circuits 72 and 74 and the second data input terminal DI 2 of the comparator 70 takes place using two AND-gates 76, 78, which can be controlled by the output signal or the inverted (80) output signal of a single-figure binary counter 82. The counting terminal C of the binary counter 82 receives counting pulses from the data output terminal DO of the comparator 70, so that the signal at the output of the binary counter 82 changes whenever one of the two desired final positions of the lifting cylinder 34 is reached, these desired final positions being able to differ from the final positions of the lifting cylinder 34 determined by construction, if the adjusting circuits 72, 74 are adjusted in a corresponding manner.

The output signal of the binary counter 82 or its inverted (80) output signal are also sent to one input respectively of two further AND-gates 84, 86. The second inputs of the AND-gates receive the output signal of the comparator 70 or the output signal of the microphone 58, transmitted by way of a delay member 88.

The outputs of the AND-gates 84, 86 are connected to the re-setting terminal R or the setting terminal S of a bistable flip-flop circuit 90 and its "0"-output or "1"- output act by way of amplifiers 92, 94 on the operating magnets of a 4/3 reversing valve 96, whereof both working apertures are connected by way of lines 98, 100 to the working chambers of the lifting cylinder 34.

As can be seen from FIG. 2, in its inoperative position (central position) pre-set for example by springs which are not shown in detail, the reversing valve 96 connects the two working chambers of the lifting cylinder 34, while a pressure line 102 coming from a pump which is not shown and a return line 104 leading to a pressure medium sump which is likewise not shown, are closed.

The first working position of the reversing valve 96 is obtained when the piston rod 32 of the lifting cylinder 34 has travelled downwards (output signal of the binary counter 82 is at a low level) and after the impact of the driving weight 12 on the driving member 18, the time interval corresponding to the delay member 88 has elapsed. Under these conditions, the bistable flip-flop circuit 90 is then set, due to which the reversing valve 96 is adjusted so that the line 98 leading to the lower working chamber of the lifting cylinder 34 is supplied with pressure medium. Under these conditions, the AND-gate 76 is switched at the same time so that now the reference value for the upper final position of the piston rod 32 is sent to the second data input DI 2 of the comparator 70. The piston rod 32 is now extended and lifts the driving weight 12 once more. Accordingly the measuring rule 46 is also raised and the counter 66 counts upwards. If the position of the measuring rule 46 measured in this way corresponds to the desired drop height for the driving weight 12, the output DO of the comparator 70 receives a signal which switches over the binary counter 82 and at the same time re-sets the bistable flip-flop circuit 90 by way of the AND-gate 82 which is now switched, due to which the reversing valve 96 is brought immediately into its second working position. In this position, the upper working chamber of the lifting cylinder 34 is now supplied with pressure medium, so that the piston rod 32 is retracted rapidly and the driving weight 12 may drop freely onto the driving member 18.

When the lifting cylinder 34 reaches a sufficiently retracted position, as is adjusted at the adjusting circuit 74 for the lower final position, the output DO of the comparator 70 receives a further conformity signal, whereupon the voltage at the output of the binary counter 82, which had been at a high level on reaching the desired drop height for the driving weight 12, now becomes low level again. Thus the comparator 70 again receives the reference value for the upper final position of the piston rod 32 and at the same time the excitation of the reversing valve 96 is interrupted, for which purpose an AND-gate 106 precedes the amplifier 94. The two input terminals of the AND-gate 106 are connected to the "0"-output terminal of the bistable flip-flop circuit 90 or the output D0 of the binary counter 82. The reversing valve 96 now returns again to its inoperative position illustrated in FIG. 2. Should the driving weight 12 move in an unforseen manner somewhat beyond the intended lower final position and thus once more come into abutment with the piston rod 32, the latter can be moved by the driving weight 12 without any fear of damage.

In the embodiment illustrated in FIG. 2, the output signal of the microphone 58 is simultaneously used for evaluating the actual driving-in conditions. Connected to the output of the microphone 58 is an analyser circuit 108, which evaluates whether the driving operation carried out is short and hard or relatively soft and long. For this purpose the analyser circuit 108 may determine for example the amplitude and the half width of the voltage pulse emitted by the microphone 58. According to an instruction programmed into the analyser circuit 108, this circuit may then calculate an impact hardness parameter, which moves for example in the range of 1 (very soft impact) to 10 (very hard impact). The corresponding electrical signal made available at the output of the analyser circuit 108 may be used first of all for controlling the delay time of the delay member 88 and indeed to the effect that the delay time is increased for soft impacts and reduced for hard impacts. In addition the output signal of the analyser circuit 108 may be used for addressing two reference value memories 110, 112, from which a reference value for the upper and lower final position of the piston rod 32 of the lifting cylinder 34 adapted to the hardness of the sub-soil can be called up.

We claim:

1. A hydraulic pile driver, with a driving weight, with a guide device for the driving weight, with a double-acting lifting cylinder acting on the driving weight and with a source of pressure medium which can be connected by way of a reversing valve to one or the other of the work chambers of lifting cylinder, wherein a position indicator cooperates with a driven part of the lifting cylinder and an output signal of this position indicator is used in the change-over of the reversing valve from its first working position, in which the lifting cylinder is acted upon in the direction of an extension of its driven part into its second working position in which the lifting cylinder is supplied with pressure medium in the direction of a retraction of its driven part, characterized in that the position indicator comprises a measuring rule (46) connected to the driven part (32) of the lifting cylinder (34) and a sensor (50) cooperating with marks (60) on the measuring rule (46), and in that the output signal of the sensor (50) is sent to a digital counter (66), which can be reset by the output signal of a final position sensor (52), which is actuated in one of the end positions of an lifting cylinder (34).

2. Hydraulic pile driver according to claim 1 characterized by an impact indicator (58) which responds when the driving weight (12) falls onto a driving member (18) located therebelow and whereof the output signal is used in the change-over of the reversing valve (96) from its second working position into its first working position.

3. Hydraulic pile driver according to claim 2 characterized by a delay member (88) following the impact indicator (58).

4. Hydraulic pile driver according to claim 3 characterized in that the impact indicator (58) comprises a microphone.

5. Hydraulic pile driver according to claim 1 characterized in that at least in the region of the marks (60) the measuring rule (46) is made from magnetisable material and the sensor (50) is an inductive sensor.

6. Hydraulic pile driver according to claim 1 characterized in that in one end position the measuring rule (46) is inserted with clearance substantially completely in a stationary protective sleeve (46).

7. Hydraulic pile driver according to claim 6 characterized by a comparator (70) receiving the output signal of the counter (66) and a reference value signal for an upper final position of the driven part (32) of the lifting cylinder (34), by which the reversing valve (96) is switched from one into the other working position when the input signals supplied to the comparator are the same.

8. Hydraulic pile driver according to claim 7 characterized by an AND-gate (86) which receives a working signal derived (82) from the output signal of the comparator (70) for adjusting the first working position of the reversing valve (96) and the output signal of an impact indicator (58) which responds when the driving member (12) falls onto a driving member (18) located therebelow and whereof the output signal serves for moving the reversing valve (96) into its first working position.

9. Hydraulic pile driver according to claim 8 characterized by a further adjustable reference value generator (74) for the lower final position of the driven part (32) of the lifting cylinder (34), which is preferably adjusted likewise depending on the output signal of the analyzer circuit (108) connected to the impact indicator (58).

10. Hydraulic pile driver according to claim 7 characterized by an adjustable reference value generator (72) for the upper final position of the driven part (32) of the lifting cylinder (34).

11. Hydraulic pile driver according to claim 10 characterized by an analyzer circuit (108) receiving the output signal of the impact indicator (58), the output signal of which circuit serves for adjusting the reference value generator (72).

12. Hydraulic pile driver according to claim 1 characterized in that the final position sensor (52) is actuated by the measuring rule (46) connected to the driven part (32) of the lifting cylinder (34).

* * * * *